US006752076B2

(12) United States Patent
Hara

(10) Patent No.: US 6,752,076 B2
(45) Date of Patent: Jun. 22, 2004

(54) STENCIL PRINTING MACHINE AND CONTROL METHOD THEREOF

(75) Inventor: Yoshikazu Hara, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 44 days.

(21) Appl. No.: 09/920,651

(22) Filed: Aug. 3, 2001

(65) Prior Publication Data

US 2002/0017207 A1 Feb. 14, 2002

(30) Foreign Application Priority Data

Aug. 7, 2000 (JP) ..... P2000-238948

(51) Int. Cl.[7] ..... B42M 1/12
(52) U.S. Cl. ..... 101/129; 101/116; 400/74
(58) Field of Search ..... 101/116, 117, 101/118, 119, 120, 129; 400/74

(56) References Cited

U.S. PATENT DOCUMENTS 4,905,595 A * 3/1990 Jeschke ..... 101/174
5,375,516 A * 12/1994 Hasegawa ..... 101/116
5,537,920 A * 7/1996 Hasegawa et al. ..... 101/116
5,553,537 A * 9/1996 Hara ..... 101/116
5,671,670 A * 9/1997 Takahashi et al. ..... 101/116
5,713,274 A * 2/1998 Kawai et al. ..... 101/114
5,911,527 A * 6/1999 Aruga et al. ..... 400/149
6,095,040 A * 8/2000 Ashikagaya et al. ..... 101/120
6,129,013 A * 10/2000 Takasawa et al. ..... 101/114
6,345,573 B1 * 2/2002 Motoe et al. ..... 101/116
6,374,730 B1 * 4/2002 Kuratani et al. ..... 101/115
6,631,674 B2 * 10/2003 Hara et al. ..... 101/116

FOREIGN PATENT DOCUMENTS

| | | |
|---|---|---|
| JP | 04-329175 | 11/1992 |
| JP | 08-204926 | 8/1996 |
| JP | 09-301618 | 11/1997 |

* cited by examiner

*Primary Examiner*—Daniel J. Colilla
*Assistant Examiner*—Jill E. Culler
(74) *Attorney, Agent, or Firm*—Nath & Associates PLLC; Marvin C. Berkowitz; Derek Richmond

(57) ABSTRACT

A stencil printing machine (10) having plural printing drums and a control method thereof can perform correctly a stencil printing process so that even if one or more errors occur in a printing drum (1 or 2) which is not used in the current printing process, another printing drum (1 or 2) is used.

6 Claims, 9 Drawing Sheets

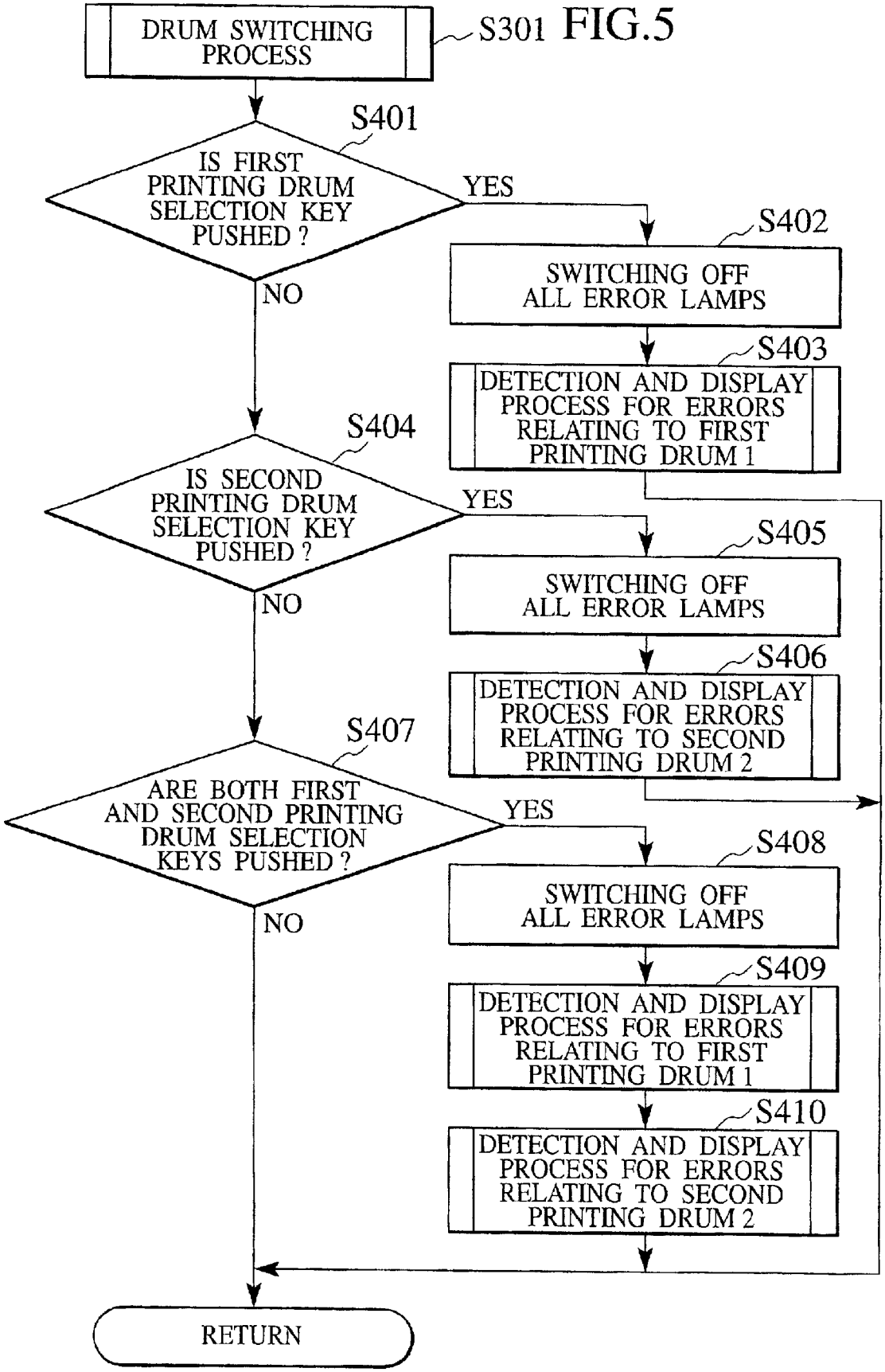
DRUM SWITCHING PROCESS
S301
FIG.5
S401
IS FIRST PRINTING DRUM SELECTION KEY PUSHED ?
YES
NO
S402
SWITCHING OFF ALL ERROR LAMPS
S403
DETECTION AND DISPLAY PROCESS FOR ERRORS RELATING TO FIRST PRINTING DRUM 1
S404
IS SECOND PRINTING DRUM SELECTION KEY PUSHED ?
YES
NO
S405
SWITCHING OFF ALL ERROR LAMPS
S406
DETECTION AND DISPLAY PROCESS FOR ERRORS RELATING TO SECOND PRINTING DRUM 2
S407
ARE BOTH FIRST AND SECOND PRINTING DRUM SELECTION KEYS PUSHED ?
YES
NO
S408
SWITCHING OFF ALL ERROR LAMPS
S409
DETECTION AND DISPLAY PROCESS FOR ERRORS RELATING TO FIRST PRINTING DRUM 1
S410
DETECTION AND DISPLAY PROCESS FOR ERRORS RELATING TO SECOND PRINTING DRUM 2
RETURN

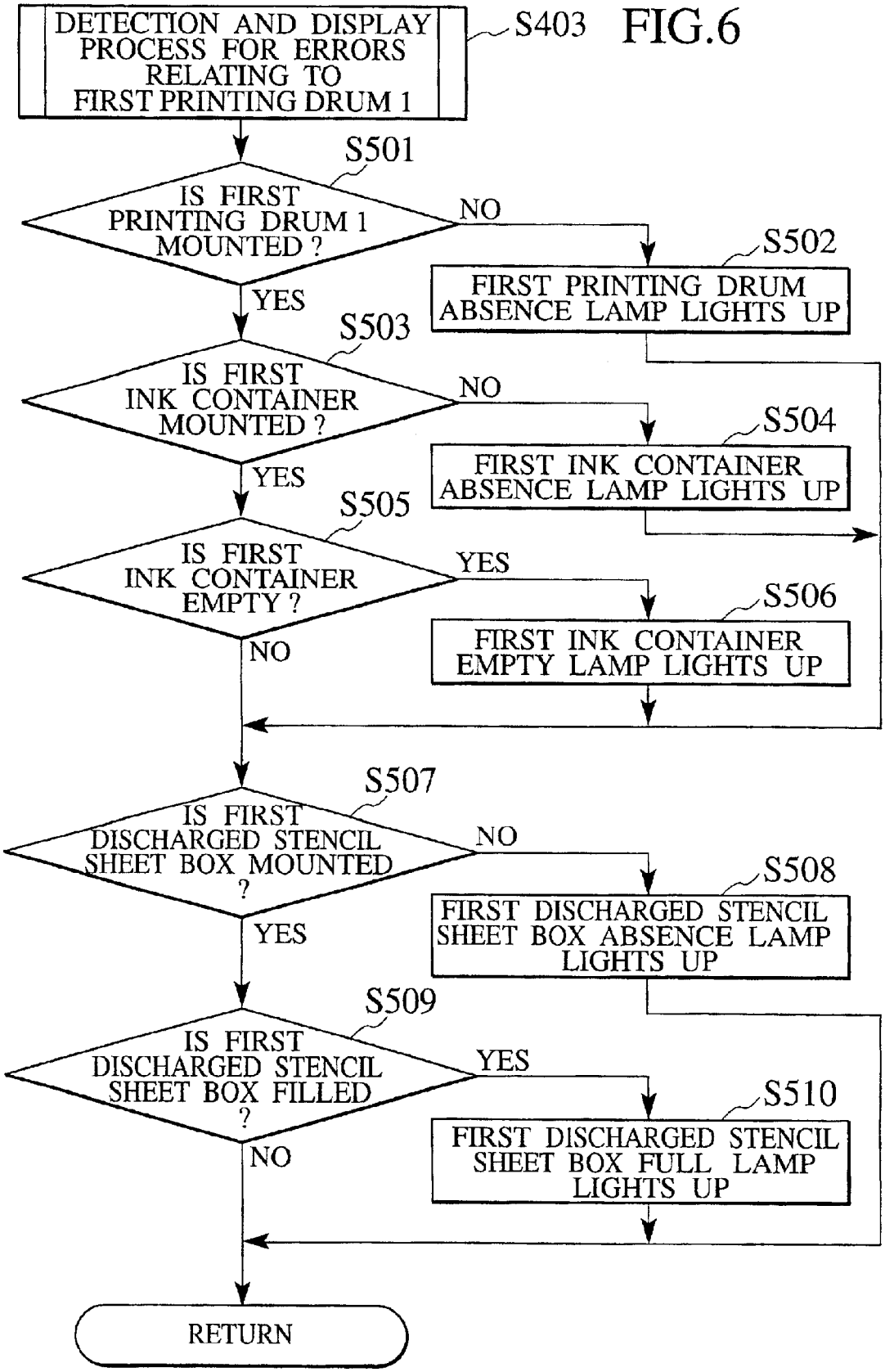
DETECTION AND DISPLAY PROCESS FOR ERRORS RELATING TO FIRST PRINTING DRUM 1
S403
FIG.6
S501
IS FIRST PRINTING DRUM 1 MOUNTED ?
NO
YES
S502
FIRST PRINTING DRUM ABSENCE LAMP LIGHTS UP
S503
IS FIRST INK CONTAINER MOUNTED ?
NO
YES
S504
FIRST INK CONTAINER ABSENCE LAMP LIGHTS UP
S505
IS FIRST INK CONTAINER EMPTY ?
YES
NO
S506
FIRST INK CONTAINER EMPTY LAMP LIGHTS UP
S507
IS FIRST DISCHARGED STENCIL SHEET BOX MOUNTED ?
NO
YES
S508
FIRST DISCHARGED STENCIL SHEET BOX ABSENCE LAMP LIGHTS UP
S509
IS FIRST DISCHARGED STENCIL SHEET BOX FILLED ?
YES
NO
S510
FIRST DISCHARGED STENCIL SHEET BOX FULL LAMP LIGHTS UP
RETURN

STENCIL PRINTING MACHINE AND CONTROL METHOD THEREOF

CROSS-REFERENCE TO RELATED APPLICATION

This application claims benefit of priority under 35 USC §119 to Japanese Patent Application No.P2000-238948, filed on Aug. 7, 2000, the entire contents of which are incorporated herein by reference.

BACKGROUND OF THE INVENTION

1. Field of the Invention

The present invention relates to a stencil printing machine and a control method thereof having a plurality of printing drums capable of performing multi-color printing.

2. Description of the Related Art

In general, a stencil printing machine having plural printing drums capable of performing mono-color and multi-color printing comprises a first printing drum 111*a*, a second printing drum 111*b*, and a pressure drum 112 which are arranged rotatably, as shown in FIG. 1. Each of the first and second printing drums 111*a* and 111*b* are placed closely at the outer peripheral surface of the pressure drum 112 separated to each other in approximately a 90 degree angle around the center of the pressure drum 112.

In the initiation of the stencil printing process, firstly, stencil sheet clamp sections of both the first and second printing drums 111*a* and 111*b* clamp corresponding stencil sheets having perforations made based on the first and second color printing data so that they are rolled on the outer peripheral surface of the corresponding printing drums. Following this process, a print paper is fed between the first printing drum 111*a* and the pressure drum 112 from the paper feed section 113 while the first and second printing drums 111*a* and 111*b* rotate around the arrow A in synchronization of the rotation of the pressure drum 112 around the arrow B.

Thereby, a print paper clamp section in the pressure drum 112 clamps the print paper which is fed and whereby the paper is further fed between the first printing drum 111*a* and the pressure drum 112 through the outer peripheral surface of the pressure drum 112. At this time, a first color ink is transferred onto the print paper through perforations made in the stencil sheet.

Next, the print paper from the first printing drum 111*a* is fed between the second printing drum 111*b* and the pressure drum 112. Similar to the first color printing process described above, the second color ink is transferred to the print paper through perforations made in the stencil sheet rolled on the second printing drum 111*b*. A paper delivery section 114 then delivers to a predetermined position the print paper on which a desired printing image data has been printed. Finally, the stencil sheets rolled on the outer peripheral surface of the printing drums 111*a* and 111*b* are disposed into discharged stencil sheet boxes 115*a* and 115*b*. Thereby, a series of the stencil printing process is completed.

By the way, the stencil printing machine of the configuration described above has a drawback in which the entire printing process, specifically, a mono-color printing process can not be performed when one of printing drums is not mounted in the machine, or no ink cartridge is mounted, or the ink cartridge is empty, or no discharged stencil sheet box is mounted, or the discharged stencil sheet box is filled in one of the printing drums. In those cases, it is hard for the user to handle the stencil printing machine having the above configuration, specifically, in order to perform a mono-color printing.

SUMMARY OF THE INVENTION

Accordingly, an object of the present invention is, with due consideration to the drawbacks of the conventional technique, to provide a stencil printing machine and a control method thereof capable of improving the user-handling of the stencil printing machine and the stencil printing process.

In accordance with an embodiment of the present invention, a stencil printing machine comprises a plurality of printing drums and a control section controlling a stencil printing process so that even if the printing drum that is not used in the current stencil printing process is in an error state, the stencil printing process is performed by using other printing drums. By this configuration of the stencil printing machine, it is possible to perform the stencil printing process using the printing drum which the user selects in the process without causing any trouble even if one printing drum which is not used in the process is in the error state.

Furthermore, in accordance with another embodiment of the present invention, a control method of a stencil printing machine having a plurality of printing drums comprises a control step of controlling a stencil printing process. In the control step, even if the printing drum that is not used in the current stencil printing process is in an error state, the stencil printing process is performed by using other printing drums. By this control method, it is possible to perform the stencil printing process using the printing drum which the user selects in the process without causing any trouble even if one printing drum which is not used in the process is in the error state.

Moreover, in accordance with another embodiment of the present invention, a control method of a stencil printing machine having a plurality of printing drums capable of performing mono-color and multi-color printing processes comprises a control step in which a stencil printing process is so controlled that even if the printing drum which is not used in an error state, the mono-color printing process is performed by using other printing drums. By this control method, even if the printing drum that is not used is in the error state, it is possible to perform the mono-color printing process by using other printing drums.

The stencil printing machine described above comprises a printing drum absence detection section comprising detectors provided to a corresponding printing drum detecting whether or not each of the printing drums is mounted in the stencil printing machine, a discharged stencil sheet box absence detection section comprising detectors provided to a corresponding printing drum detecting whether or not the discharged stencil sheet box is mounted in the corresponding printing drum, and a discharged stencil sheet box full detection section comprising detectors provided to a corresponding discharged stencil sheet box detecting whether or not the discharged stencil sheet box is filled with used stencil sheets. In addition, each printing drum further comprises an ink container detection section detecting whether or not the ink container is mounted in the corresponding printing drum, and an ink sensor section detecting whether or not an ink is filled in the corresponding ink container in the printing drum. In the stencil printing machine, the control section controls the stencil printing process based on detection results of the above detection sections.

Furthermore, the stencil printing machine described above further comprises an operation panel displaying error information and through which a user selects one or more of the printing drums to be used in the stencil printing process and instructs to initiate the stencil printing process. In the stencil printing machine, the operation panel comprises at least one of the display sections to inform the following error states for each printing drum to the user: no printing drum is mounted; no ink container is mounted; ink container is empty; no discharged stencil sheet box is mounted; and a discharged stencil sheet box is filled with discharged stencil sheets.

BRIEF DESCRIPTION OF THE DRAWINGS

These and other objects, features, aspects and advantages of the present invention will become more apparent from the following detailed description of the present invention when taken in conjunction with the accompanying drawings, in which:

FIG. 5 is a flow chart showing a printing drum switching process in the stencil printing process according to an embodiment of the present invention;

FIG. 6 is a flow chart showing a printing drum error detection process in the stencil printing process according to an embodiment of the present invention;

DETAILED DESCRIPTION OF THE PREFERRED EMBODIMENTS

Other features of this invention will become apparent through the following description of preferred embodiments which are given for illustration of the invention and are not intended to be limiting thereof.

First Embodiment

Hereinafter, a description will be given for the detailed explanation of the configuration of the stencil printing machine and the control method thereof according to embodiments of the present invention with reference to FIG. 2 to FIG. 9.

<Configuration of Stencil Printing Machine>

Firstly, features of the configuration of the stencil printing machine 10 according to embodiments of the present invention will be explained with reference to FIG. 2.

Figure 1:
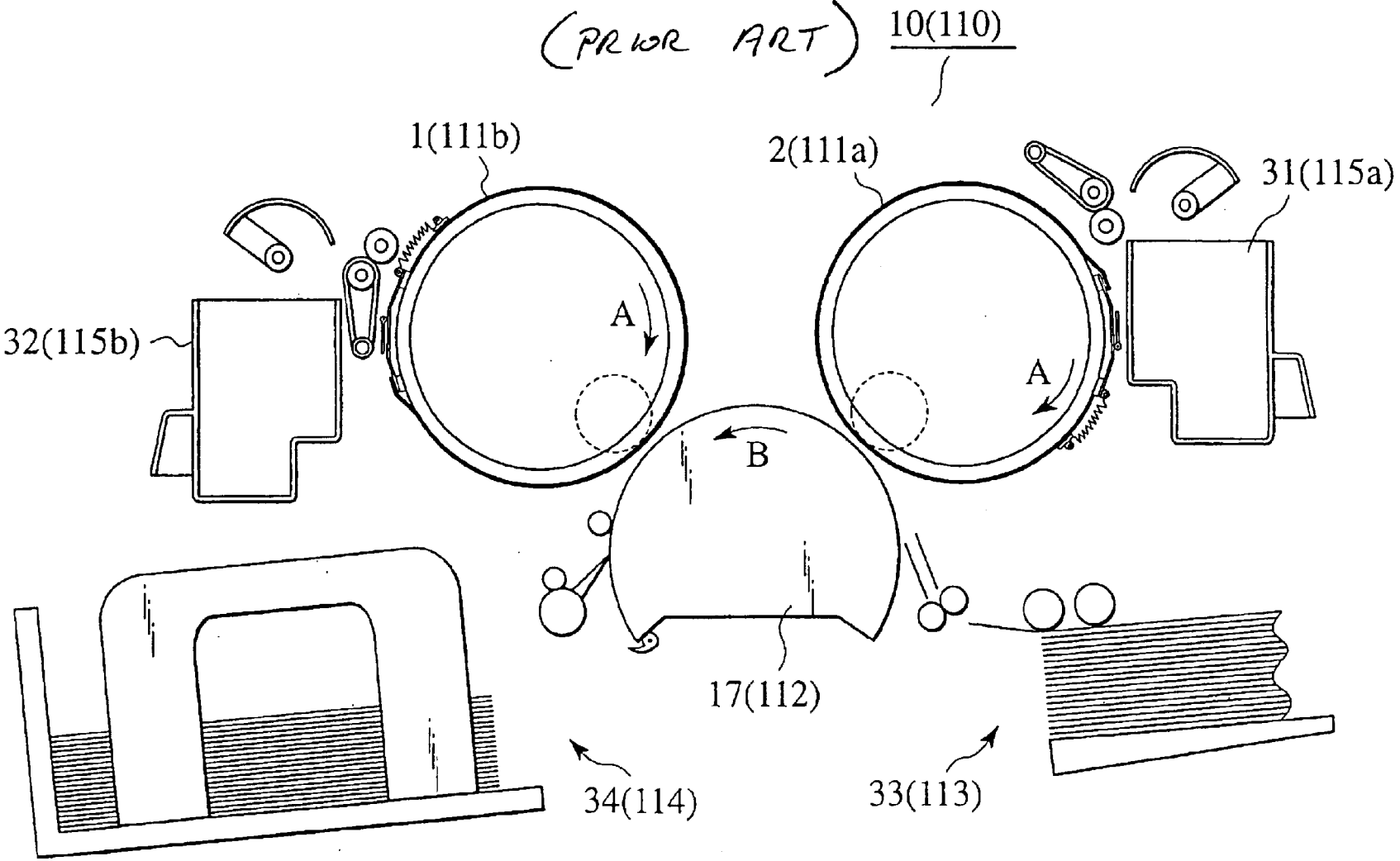
FIG.1 (PRIOR ART)
FIG. 1 is a schematic diagram showing a basic configuration of a stencil printing machine.
Figure 2:
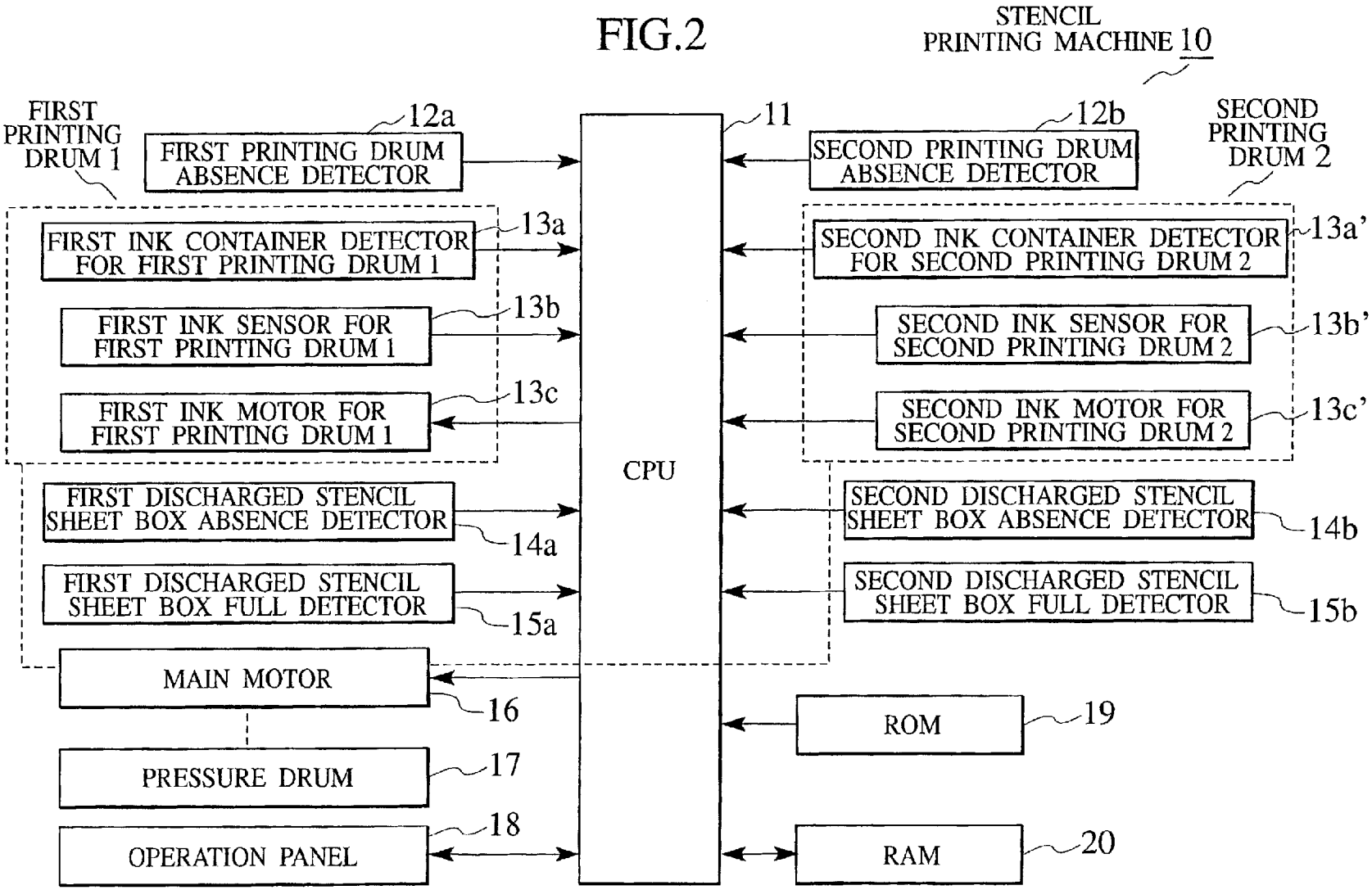
FIG. 2 is a block diagram showing a configuration of a stencil printing machine according to embodiments of the present invention.
Figure 3:
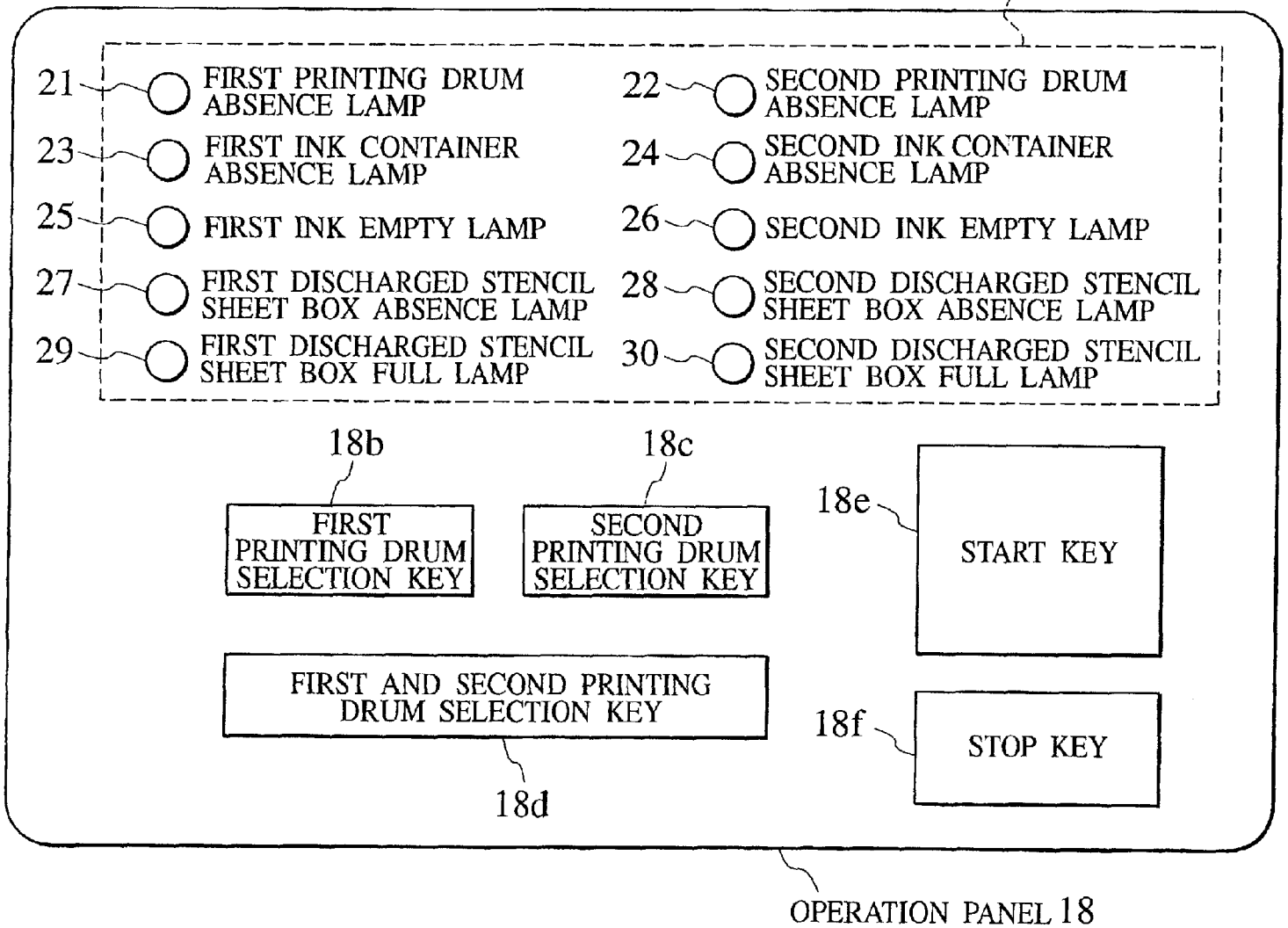
FIG. 3 is a block diagram showing a configuration of an operation panel in the stencil printing machine shown in FIG. 2.

The configuration of main basic components in the stencil printing machine 10 of the present invention shown in FIG. 2 is basically equal to that of the stencil printing machine shown in FIG. 1. That is, the first printing drum 1, the second printing drum 2, and the pressure drum 17 shown in FIG. 1 correspond to the first printing drum 1 (as a first drum), the second printing drum 2 (as a second drum), and the pressure drum 17 shown in FIG. 2, respectively. In addition, discharged stencil sheet boxes 31 and 32, a paper feed section 33, a paper delivery section 34 shown in FIG. 1 are omitted from FIG. 2.

The stencil printing machine 10 according to the embodiments of the present invention shown in FIG. 2 comprises the first printing drums 1, the second printing drum 2, a CPU (central processing unit as a control section) 11, printing drum absence detectors 12*a* and 12*b*, discharged stencil sheet box absence detectors 14*a* and 14*b* for the discharged stencil sheet boxes 31 and 32, discharged stencil sheet box full detectors 15*a* and 15*b* for the discharged stencil sheet boxes 31 and 32, a main motor 16, the pressure drum 17, the operation panel 18, a ROM 19 for storing control programs for the operation of the CPU 11, and a RAM 20 for storing data such as operation variables. In particularly, the CPU 11 controls the operation of each configuration components in the machine 10 according to the control programs stored in the ROM 19. The printing drum absence detectors 12*a* and 12*b* for the printing drums 1 and 2 detect whether or not each printing drum is mounted on the machine 10. The discharged stencil sheet box absence detectors 14*a* and 14*b* detect whether or not a discharge stencil sheet box is mounted on each corresponding printing drum. The discharged stencil sheet box full detectors 15*a* and 15*b* detect whether or not each discharged stencil sheet box is filled. The main motor 16 drives the printing drums 1 and 2 and the pressure drum 17. Through the operation panel 18, the user instructs the initiation of the operation of the printing drums 1 and 2 and the pressure drum 17 that will be used in the stencil making and printing process. The ROM 19 stores the control programs for the operation of the CPU 11.

Each printing drum comprises an ink container detector 13*a* (13*a*'), an ink sensor 13*b* (13*b*'), and an ink motor 13*c* (13*c*'). The ink container detector 13*a* (13*a*') detects whether or not the ink container is mounted on each corresponding printing drum. The ink sensor 13*b* (13*b*') detects the presence of the ink on a squeegee roller of each printing drum (namely, the ink sensor detects whether or not the ink container is empty). The ink motor 13*c* (13*c*') supplies the ink to the squeegee roller the from the ink container.

As shown in FIG. 13, the operation panel 18 comprises an error display lamp section 18*a*, a first printing drum selection key 18*b*, a second printing drum selection key 18*c*, a first and second printing drums selection key 18*d*, a start key 18*e*, and a stop key 18*f*.

The error display lamp section 18*a* displays various states (specifically, error states) relating to each of the first and second printing drums 1 and 2. The user may select stencil making and printing process for the first printing drum 1 through the first printing drum selection key 18*b* in the operation panel 18. The user may also select the stencil making and printing process for the second printing drum 2 through the second printing drum selection key 18*c*. The user may also select the stencil making and printing process for the first and second printing drums 1 and 2 through the first and second printing drums selection key 18*d*. The user may instruct to start the stencil making and printing process through the start key 18*e* and to stop the stencil making and printing process through the stop key 18*f*.

The error display lamp section 18*a* comprises a plurality of error display lamps in order to inform the following error states to the user:

No first printing drum 1 is mounted (first printing drum absence lamp 21);

No second printing drum 2 is mounted (second printing drum absence lamp 22);

No first ink container is mounted (first ink container absence lamp 23);

No second ink container is mounted (second ink container absence lamp 24);

The first color ink in the first ink container is empty (first ink empty lamp 25);

The second color ink in the second ink container is empty (second ink empty lamp 26);

No first discharged stencil sheet box for the first printing drum 1 is mounted (first discharged stencil sheet box absence lamp 27);

No second discharged stencil sheet box for the second printing drum 2 is mounted (second discharged stencil sheet box absence lamp 28);

The first discharged stencil sheet box for the first printing drum 1 is filled (first discharged stencil sheet box full lamp 29); and The second discharged stencil sheet box for the second printing drum 2 is filled (second discharged stencil sheet box full lamp 30).

<Control Method of Stencil Printing Machine>

Next, a description will be given of the control method for the stencil printing machine 10 according to the embodiments of the present invention with reference to FIG. 4 to FIG. 9.

Figure 4:
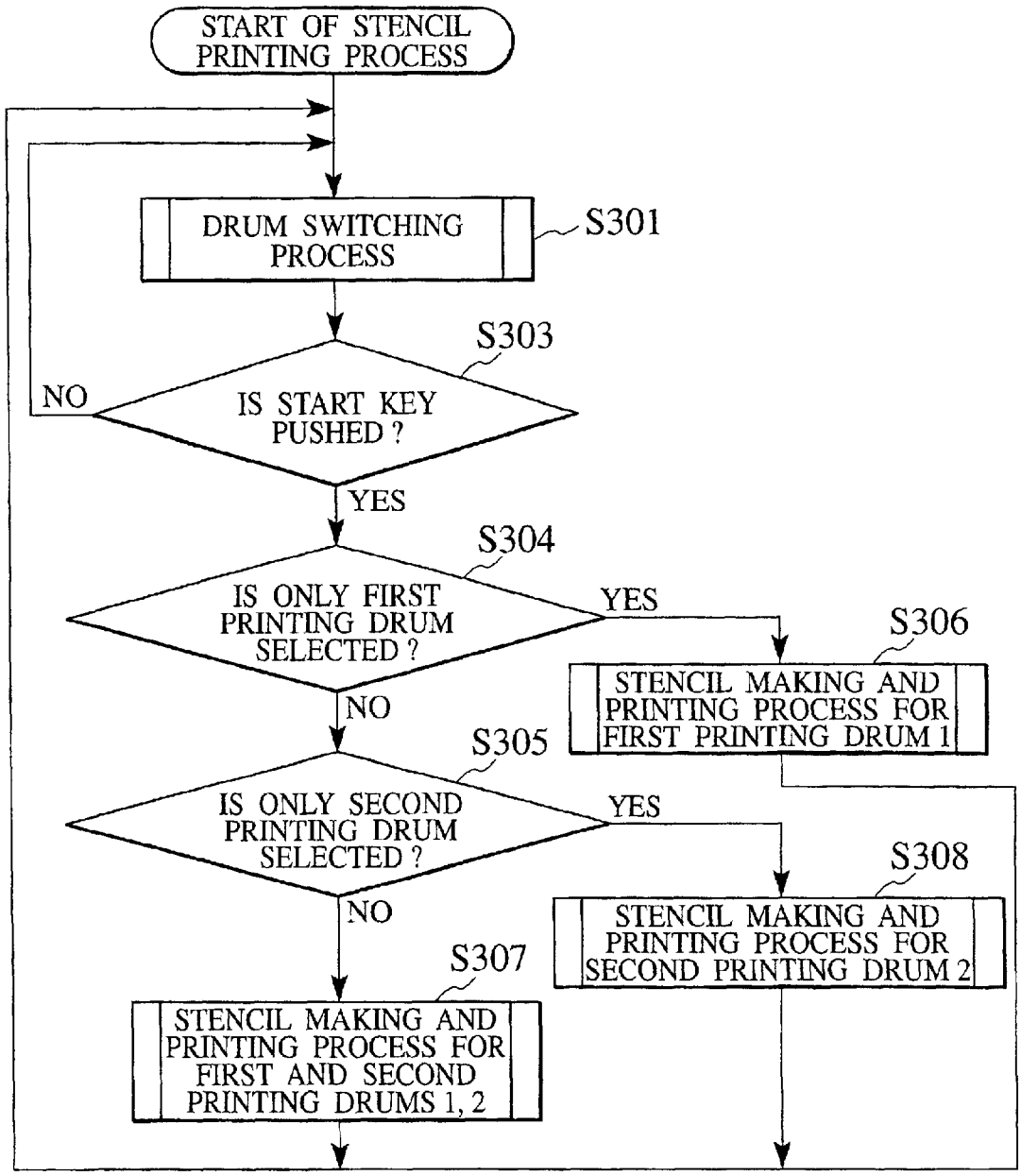
FIG. 4 is a flow chart of a stencil printing process according to an embodiment of the present invention.

The stencil printing process of the stencil printing machine 10 is controlled based on following steps S301 to S308 shown in FIG. 4.

(1) When the user selects one or more the printing drums 1 and 2 (Step S301) through the first, the second, and the first and second printing drum selection keys 18*b*, 18*c*, and 18*d* on the operation panel 18, the CPU 11 executes the following sub-steps S401 to S410 shown in FIG. 5.

(1-1) It is judged whether or not the first printing drum selection key 18*b* is pushed (S401). When the key 18*b* is pushed, the entire error display lamp section 18*a* consisting of the plural lamps currently lighting up is switched off (S402). After the following first printing drum error detection and display process is executed (S403, described later), the operation flow goes forward to Step S303. On the other hand, when the key 18*b* is not pushed, the operation flow immediately goes to the process Step S404 (see FIG. 4 and FIG. 5).

(1-2) In the step S404, it is judged whether or not the second printing drum selection key 18*c* is pushed (S404).

When the key 18*c* is pushed, the entire error display lamp section 18*a* consisting of plural lamps currently lighting up is switched off (S405). After the following second printing drum error detection and display process is executed (S406, described later), the operation flow goes forward to the process of Step S303.

On the contrary, when the key 18*c* is not pushed, the operation flow immediately goes to the process of S407 (see FIG. 4 and FIG. 5).

(1-3) In the step S407, it is judged whether or not the first and second printing drum selection key 18*d* is pushed (S407).

When the key 18*d* is pushed, the entire error display lamp section 18*a* consisting of plural lamps currently lighting up is switched off (S408). The first printing drum error detection and display process (S409, described later) and the second printing drum error detection and display process (S410, described later) are executed in order. Following these processes, the operation flow goes forward to the process of Step S303.

On the contrary, when the key 18*d* is not pushed, the operation flow immediately goes to Step S303 (see FIG. 4 and FIG. 5).

Next, a description will be given of the explanation of the printing drum error detection and display process with reference to FIG. 6. Although FIG. 6 shows the printing drum error detection and display process only for the first printing drum 1, this process can be applied to the second printing drum 2.

The error detection and display process is broadly divided into two error detection processes, the error detection for the printing drums and the error detection for the discharged stencil sheet boxes.

Firstly, the error detection for the printing drums is performed. That is, it is judged whether or not the printing drum 1 is mounted on the machine 10 (S501). When the printing drum 1 is not mounted as a result of the judgment, it is so controlled that the first printing drum absence lamp 21 in the error display lamp section 18*a* lights up (S502) and the operation flow goes forward to Step S507.

On the other hand, when a result of the judgment indicates that the first printing drum 1 is mounted correctly, it is further judged that the first ink container in the first printing drum 1 is mounted (S503).

When no first ink container is mounted, it is so controlled that the first ink container absence lamp 23 in the error display lamp section 18*a* lights up (S504) and the operation flow then goes forward to Step S507.

On the contrary, when the first ink container is mounted, it is judged the presence of an ink in it (S505). When there is no ink in the first ink container in the first printing drum 1 (namely, whether or not the first ink container is empty), it is so controlled that the first ink absence lamp 25 lights up in the error display lamp section 18*a* and the operation flow immediately goes to S507. When there is the ink in it (namely, not empty), the operation flow immediately goes forward to S507.

Next, a description will be given of the explanation of the error detection process for the discharged stencil sheet box and following processes (Step S507 to S510).

First, it is judged whether or not the first discharged stencil sheet box for the first printing drum 1 is mounted (S507). When the box is not mounted, it is so controlled that the first discharged stencil sheet box lamp 27 in the error display lamp section 18*a* lights up (S508). The series of the error detection On the other hand, when the first discharged stencil sheet box is mounted, it is judged whether or not it is filled with discharged stencil sheets (S509). When it is filled, it is so controlled that the first discharged stencil sheet box full lamp 29 lights up (S510) and the series of the error detection processes is thereby completed.

Thus, the error detection and display process judges whether or not one or more errors relating to the printing drum itself and the discharged stencil sheet box occur. If at least one error occurs, the process controls that one or more the corresponding error lamps 21 to 30 in the error display lamp section 18*a* on the operation panel 18 light up.

Next, a description will be given of the explanation of the processes S303 to S308 shown in FIG. 4.

(2) It is judged whether or not the start key 18*e* to indicate the initiation of the stencil printing process is pushed (S303). When it is not pushed as a result of this judgment, the operation flow returns to the drum switching process (Step 301).

(3) When the result of this judgment indicates that the start key 18*e* is pushed, it is judged whether or not a mono-color printing process only for the first printing drum 1 is selected (S304).

When only the first printing drum 1 is selected, the stencil making and printing process only for the first printing drum 1 will be executed (S306).

(4) When only the first printing drum 1 is not selected, it is judged whether or not a mono-color printing process only for the second printing drum 2 is selected (S305).

When the result of this judgment indicates that only the second printing drum 2 is selected, the stencil making and printing process only for the second printing drum 2 will be executed (S308).

Here, a description will be given of the explanation of the stencil making and printing process only using the first printing drum 1 (or second printing drum 2) with reference to FIG. 7.

Figure 7:
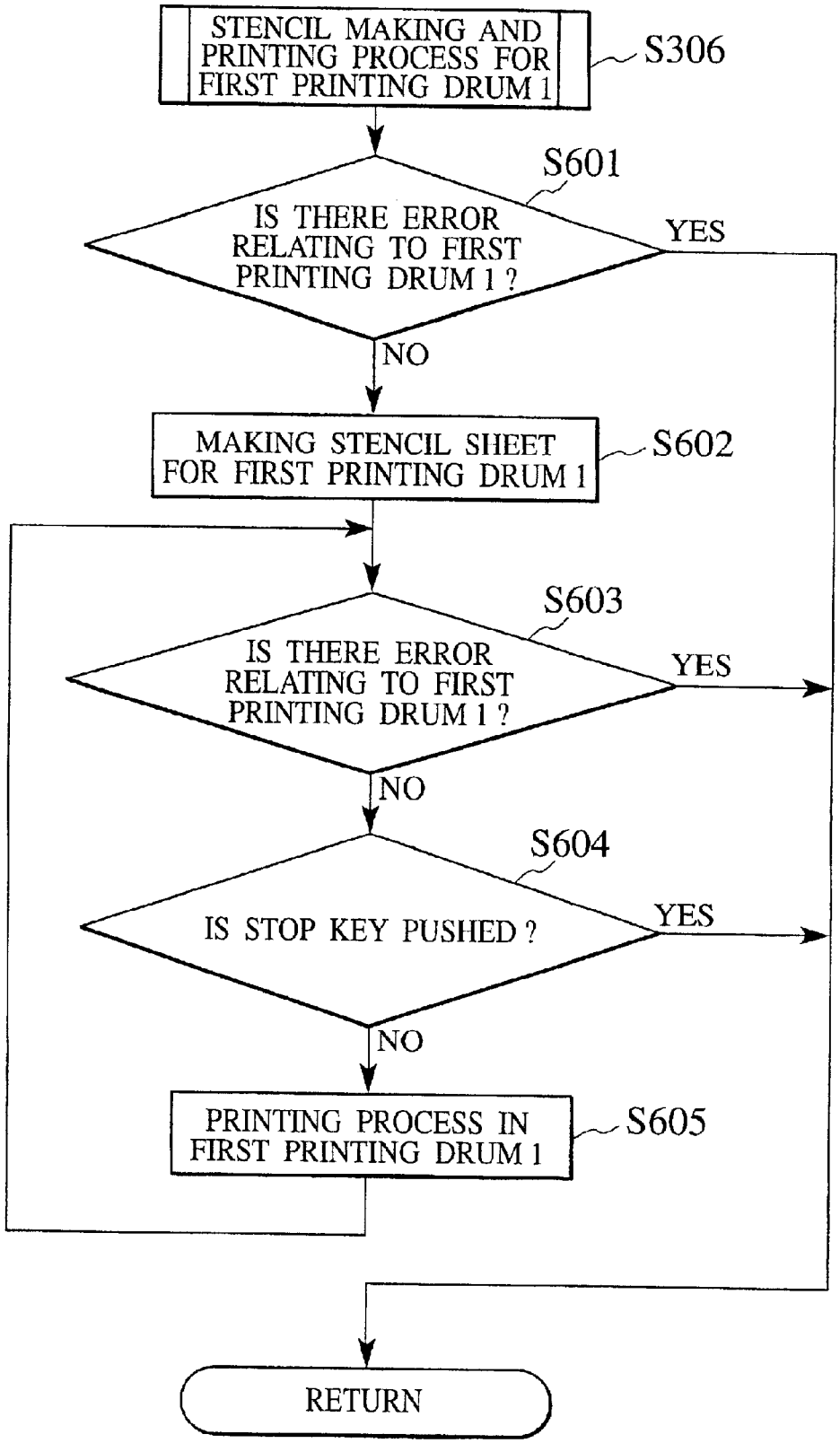
FIG. 7 is a flow chart showing a stencil making and printing process in the stencil printing process according to an embodiment of the present invention.

Although FIG. 7 shows the stencil making and printing process only for the first printing drum 1, this process can be applied to the second printing drum 2.

When the stencil making and printing process only using the first printing drum 1 is executed, at first, it is judged whether or not one or more errors relating to the first printing drum 1 occur. When a result of this judgment indicates that one or more errors occur, the machine 10 displays the information relating to the occurrence of the errors relating to the first printing drum 1 in order to inform to the user the difficulty to execute the stencil making and printing process.

On the contrary, when no error for the first printing drum 1 occurs, the stencil making process for the first printing drum 1 is executed normally (S602).

After the completion of the stencil making process, it is judged again whether or not one or more errors relating to the first printing drum 1 occur (S603). When a result of this judgment indicates that one or more errors occur, the machine 10 displays the information relating to the occurrence of the errors relating to the first printing drum 1 in order to inform to the user the difficulty to execute the following processes.

On the other hand, when the result of this judgment indicates that no error occurs and the user does not push the stop key 18*f* to halt the operation of the printing process, the printing process using printing information made on the first printing drum 1 is executed (S605).

Figure 9:
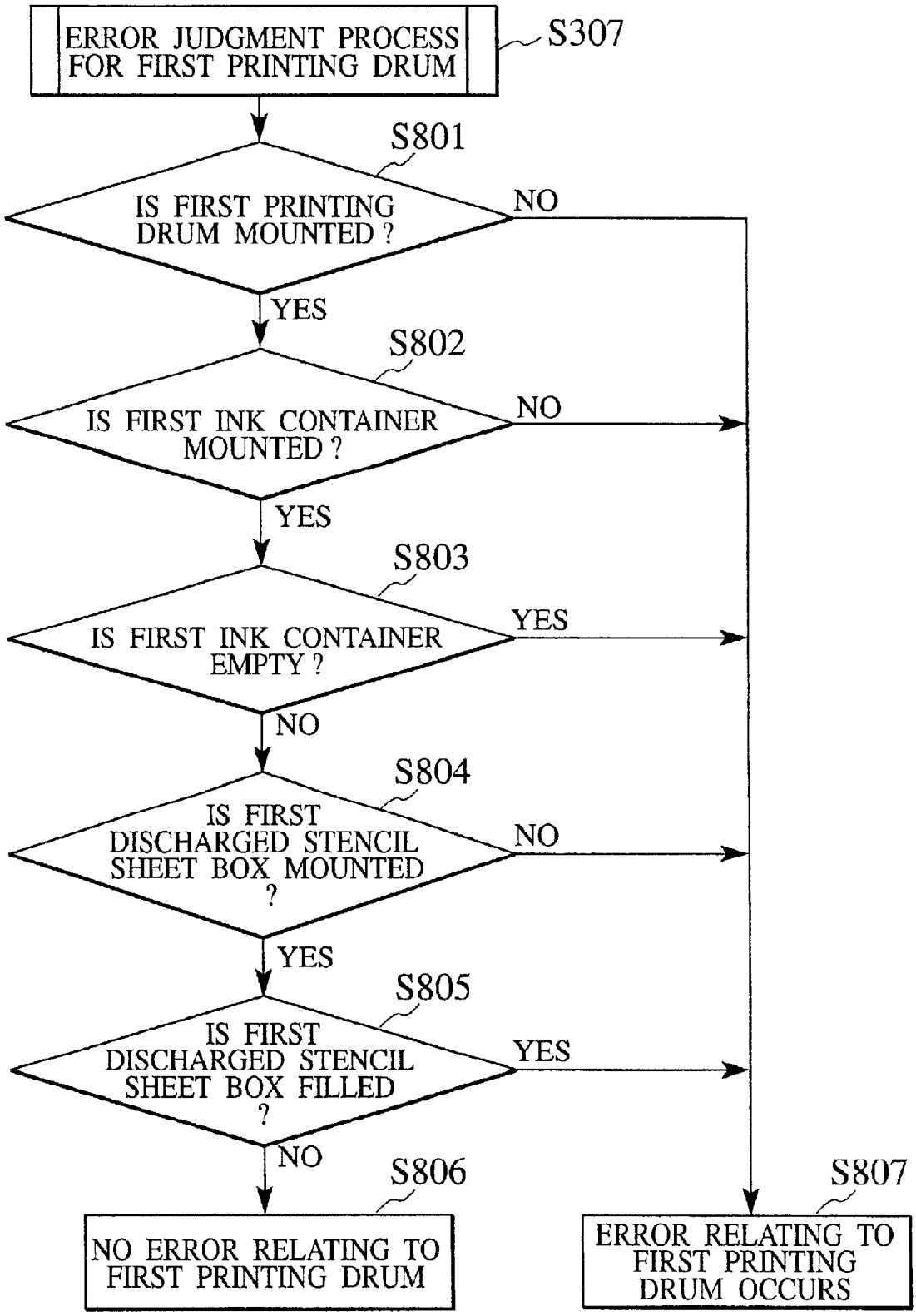
FIG. 9 is a flow chart showing an error judgment process in the stencil printing process according to an embodiment of the present invention.

The judgment to detect whether or not one or more errors relating to the first printing drum 1 occur (or one or more errors relating to second printing drum 2), as shown in FIG. 9, will be performed for the following checks in order:

Is the first printing drum 1 mounted?;

Is the first ink container for the first printing drum mounted?;

Is there ink in the first ink container for the first printing drum 1?;

Is the first discharged stencil sheet box for the first printing drum 1 mounted?; and Is the first discharged stencil sheet box filled?

When at least one error occurs, it is judged that one or more errors relating to the first printing drum 1 occur.

(5) When only the second printing drum 2 is not selected, it is judged to perform the stencil making and printing process using both the first and second printing drums 1 and 2. Thereby, the machine 10 performs this process.

Figure 8:
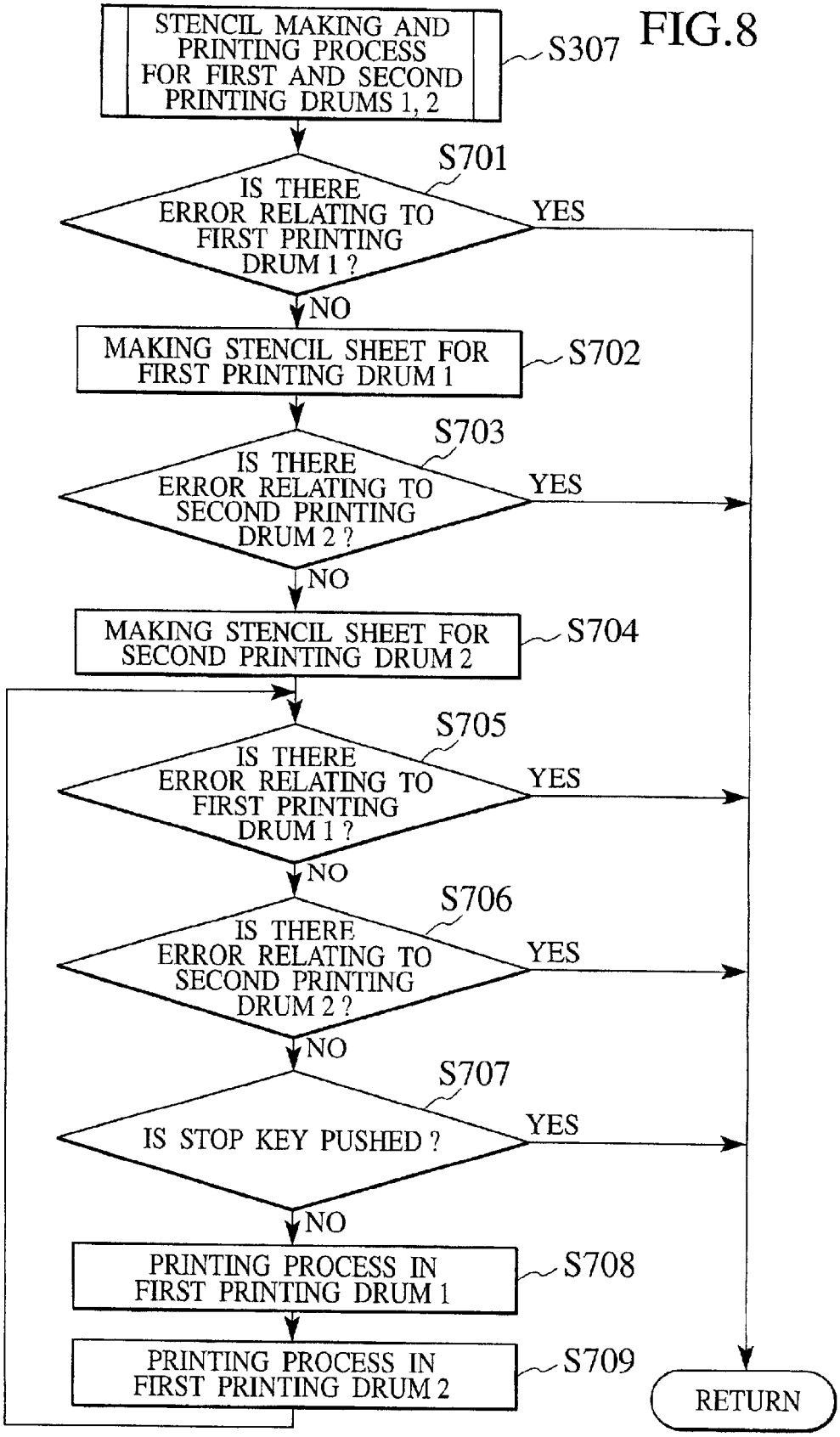
FIG. 8 is a flow chart showing another stencil making and printing process in the stencil printing process according to an embodiment of the present invention.

Here, a description will be given of the explanation of the stencil making and printing process (S307) using both the first and second printing drums 1 and 2 with reference to FIG. 8.

At first, when the stencil making and printing process using both the first and second printing drums 1 and 2 is performed, it is judged whether or not one or more errors relating to the first printing drum 1 occur (S701). When a detection result indicates that the error relating to the first printing drum 1 occurs, the machine 10 informs the user the occurrence of the error relating to the first printing drum 1 and also informs the difficulty to execute the multi-color printing process.

On the other hand, the detection result indicates that there is no error relating to the first printing drum 1, the stencil making process for the first printing drum 1 is executed (S702).

After the completion of the stencil making process for the first printing drum 1, it is judged whether or not one or more errors relating to the second printing drum 2 occur. When a detection result indicates that the error relating to the second printing drum 2 occurs, similar to the case of the first printing drum 1 prescribed, the machine 10 informs the user the occurrence of the error relating to the second printing drum 2 and also informs the difficulty to execute the multi-color printing process.

On the other hand, there is no error relating to the second printing drum 2, the stencil making process for the second printing drum 2 is executed (S704). After the completion of the stencil making process, it is judged whether or not one or more errors relating to both the first printing drum 1 and the second printing drum 2 occur in order (S705 and S706).

As a result of this judgment, when the error occurs, the machine 10 informs the user the occurrence of the error and also informs the difficulty to perform the printing process.

On the other hand, there is no error relating both the first and second printing drums 1 and 2, and when the user does not push the stop key 18*f*, the printing processes for the first and second printing drums 1 and 2 are performed in order (S708, S709).

Thus, according to the stencil printing machine and the control method of the embodiments of the present invention, even if one or more errors occur in one printing drum, it is so controlled that the stencil making and printing process is performed by using other printing drum. Therefore the user who wants to perform the mono-color printing process can handle easily the stencil printing machine.

As set forth in detail, according to the stencil printing machine and the control method of the present invention, even if one or more errors occur in a printing drum that is not used in the stencil printing process, it is so controlled that the stencil printing process can be performed by using other printing drum. Therefore the user, specifically, who wants to perform the mono-color printing process, can easily handle the stencil printing machine.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A stencil printing machine for selectively performing multi-color printing process or mono-color printing process comprising:

a plurality of printing drums adapted to be selectively one of in press contact and out of contact with a common pressure drum, each printing drum being adapted to print on a same print paper; and a control section controlling a stencil printing process such that when the plurality of printing drums are selected, a multi-color printing process is performed by the selected plurality of printing drums, and when any single printing drum is selected among the plurality of printing drums, a mono-color printing process is performed by the selected single printing drum, wherein the control section further controls the stencil printing process such that when a single printing drum is selected for the mono-color printing process but the selected printing drum is in an error state, an other printing drum is allowed to be selected to perform the mono-color printing process.

2. The stencil printing machine according to claim 1, further comprising:

a printing drum absence detection section comprising a plurality of first detectors, one of said first detectors corresponding to each printing drum for detecting whether or not each of the printing drums is mounted in the stencil printing machine;

a discharged stencil sheet box absence detection section comprising a plurality of second detectors, one of said second detectors corresponding to each printing drum for detecting whether or not a discharged stencil sheet box is mounted in the corresponding printing drum; and a discharged stencil sheet box full detection section comprising a plurality of third detectors, one of said third detectors corresponding to each discharged stencil sheet box for detecting whether or not the discharged stencil sheet box is filled with used stencil sheets, wherein each printing drum further comprises:

an ink container detection section detecting whether or not an ink container is mounted in the corresponding printing drum; and an ink sensor section detecting whether or not an ink is filled in the corresponding ink container in the printing drum, wherein the control section controls the stencil printing process based on detection results of the above detection sections.

3. The stencil printing machine according to claim 1, further comprising an operation panel displaying error information and through which a user selects one or more printing drums to be used in the stencil printing process and initiates the stencil printing process, wherein the operation panel comprises at least one display section to inform the user of one of the following error states for each printing drum:

no printing drum is mounted;

no ink container is mounted;

ink container is empty;

no discharged stencil sheet box is mounted; and discharged stencil sheet box is filled with discharged stencil sheets.

4. A control method of a stencil printing machine for selectively performing multi-color printing process or mono-color printing process, said stencil printing machine having a plurality of printing drums adapted to be selectively one of in press contact and out of contact with a common pressure drum, each printing drum being adapted to print on a same print paper, the method comprising:

a control step that when the plurality of printing drums are selected, a multi-color printing process is performed by the selected plurality of printing drums, and when any single printing drum is selected among the plurality of printing drums, a mono-color printing process is performed by the selected single printing drum; and a control step that when a single printing drum is selected for the mono-color printing process but the selected printing drum is in an error state, an other printing drum is allowed to be selected to perform the mono-color printing process.

5. A stencil printing machine for selectively performing multi-color printing process or mono-color printing process comprising:

a plurality of printing drums;

a control section controlling a stencil printing process such that when the plurality of printing drums are selected, a multi-color printing process is performed by the selected plurality of printing drums, and when any single printing drum is selected among the plurality of printing drums, a mono-color printing process is performed by the selected single printing drum; and an operation panel displaying error information and through which a user can select either one of one printing drum and the plurality of printing drums to be used in the stencil printing process and initiates the stencil printing process, wherein the control section further controls the stencil printing process such that when a single printing drum is selected for the mono-color printing process but the selected printing drum is in an error state, an other printing drum is allowed to be selected to perform the mono-color printing process.

6. A method of stencil printing using a stencil printing machine for selectively performing multi-color printing process or mono-color printing process, said stencil printing machine including a plurality of printing drums, a control section controlling a stencil printing process such that when the plurality of printing drums are selected, a multi-color printing process is performed by the selected plurality of printing drums, and when any single printing drum is selected among the plurality of printing drums, a mono-color printing process is performed by the selected single printing drum, even if one of the printing drums not being used in the current stencil printing process is in an error state, the stencil printing process is performed by other printing drums, and an operation display panel displaying error information and through which a user can select either one of one printing drum and the plurality of printing drums to be used in the stencil printing process and initiates the stencil printing process, the method comprising:

judging whether one or more errors exist in relation to a single or the plurality of printing drums selected by a user;

displaying error information on the operation panel if an error exists so that the user can rectify the machine to remove the error or choose other printing drums to perform a mono-color printing process; and performing the printing process using the selected printing drums if no error exists.

* * * * *